US005685206A

United States Patent [19]

Ma

[11] Patent Number: 5,685,206

[45] Date of Patent: Nov. 11, 1997

[54] MULTI-PURPOSE TOOL

[76] Inventor: James W. Ma, 98 Fleetwood Dr., Glendale Heights, Ill. 60139

[21] Appl. No.: 588,968

[22] Filed: Jan. 19, 1996

[51] Int. Cl.[6] ..... B25B 13/10

[52] U.S. Cl. ..... 81/77; 81/437; 7/139

[58] Field of Search ..... 81/77, 437, 439, 81/440, 129, 155, 165, DIG. 4, 125.1, 489; 7/138, 139, 165

[56] References Cited

U.S. PATENT DOCUMENTS

| | | | |
|---|---|---|---|
| 509,151 | 11/1893 | Dicks | 81/437 |
| 1,321,187 | 11/1919 | Brower . | |
| 2,912,891 | 11/1959 | Neff | 81/167 |
| 3,363,490 | 1/1968 | Maichen | 81/77 |
| 3,370,307 | 2/1968 | Beeks | 7/138 |
| 4,787,275 | 11/1988 | Colvin | 81/77 |
| 4,811,637 | 3/1989 | McCleary | 81/489 |
| 5,218,891 | 6/1993 | Olson et al. | 81/125.1 |

FOREIGN PATENT DOCUMENTS

| | | | |
|---|---|---|---|
| 96785 | 4/1898 | Germany | 81/77 |
| 424577 | 1/1926 | Germany . | |
| 551492 | 6/1932 | Germany | 7/139 |
| 4277 | 11/1902 | United Kingdom . | |
| 12484 | 11/1904 | United Kingdom . | |

*Primary Examiner*—D. S. Meislin
*Assistant Examiner*—Joni B. Danganan
*Attorney, Agent, or Firm*—Fitch, Even, Tabin & Flannery

[57] ABSTRACT

A multi-purpose tool is provided and includes first and second elongate body members each having first and second ends. A torque surface is formed at one of the first and second ends of each of the body members. The torque surfaces are adapted for engagement with workpiece surfaces such as the flats of polygonal fastening elements. Driver heads are formed at the other ends of the body members and are adapted for engagement in slots of slotted fastening elements with the first body member driver head configured differently from the second body member driver head. The body members are secured together to allow relative movement therebetween with the torque surface of the first body member and the torque surface of the second body member generally facing each other to define an adjustable opening therebetween. The driver heads of the body members are adjacent to each other for exposing one of the heads beyond the other. A single adjusting nut is provided and screw threads are formed on one of the body members and receiving and cooperating with the nut thereon to allow the nut to be turned to move the body members relative to each other and simultaneously: (1) change the size of the opening between the torque surfaces of the body members for engaging differently sized polygonal fastening elements, and (2) move the driver heads for exposing an appropriately configured one of the driver heads beyond the other drive head for matingly engaging slotted fastening elements having differently configured slots.

4 Claims, 6 Drawing Sheets

MULTI-PURPOSE TOOL

FIELD OF THE INVENTION

This invention relates to a multi-purpose tool and, more particularly, to a manually operable tool which can be utilized to apply torque to fastening elements as a wrench and to slotted fastening elements as a driver.

BACKGROUND OF THE INVENTION

Screw fasteners are commonly used for attaching two bodies together with a connection that can be disassembled and reconnected as required. Most threaded fasteners have a threaded cylindrical rod with some form of head on one end. Standard hexagon wrench head bolts and nuts are one common form of screw fasteners. Nuts and bolts can vary in size according to the application and load they must bear. Screw fasteners having slotted heads are also available and are employed principally on small work.

As applications and, accordingly, the size of screw fasteners vary, hand-held manually operable and power-driven tools have been developed which allow for torque to be applied to different types and sizes of screw fasteners. For example, manual tools are known in which a plurality of driver heads, such as Phillips and flat blade bits may be interchanged for use on a single handle. Similarly, it is known to provide a plurality of differently sized socket bits which may be interchanged on a single ratchet driver handle to allow for a wide variety of differently sized screw fastener heads to be torqued. The problem with using these tools having interchangeable bits, such as the Phillips head and flat blade bits for slotted fasteners and the socket bits described above, is that initially the bits must be stored, then the proper type and size of bit must be selected, removed from its storage container, attached to its handle and then detached therefrom and placed back in storage after use. Obviously, such a procedure can lead to loss of the bits and where a significant number of bits are stored, require an appropriately sized container often taking up several times the space required for the actual driver handle itself. Accordingly, there is a need for a hand tool which provides for flexibility in engaging a variety of different sizes of screw fasteners and applying torque thereto in a more compact manner.

In addition to the socket wrenches described above, it is known to provide wrenches with adjustable jaws such as crescent, box and pipe wrenches for engaging and applying torque to differently sized fasteners. While these conventional wrenches do not utilize different bits and therefore are relatively compact while still capable of engaging different size fastening elements, they do not have the capability to engage slotted fastening elements. In this regard, combination tools have been disclosed such as in published British specification No. 12,484 which discloses a tool having adjustable pipe wrench-type jaws at one end and a non-adjustable crescent wrench-type head at the other end and having a flat blade driver formed at the end of one of the crescent jaws. This combination is a relatively bulky tool and while providing for both driving and wrench operations, it is not as versatile as is desirable in that there is only a single driver type. Furthermore, as the handle for the crescent wrench head and driver is curved and the driver is formed at the end of one of the crescent wrench head jaws, the design can cause problems with utilizing the driver as it may be difficult to engage fastening elements and apply torque thereto, particularly in confined areas.

German Patent No. 551,492 discloses a tool which has differently sized flat blade drivers which can be extended from one end of the tool and an adjustable crescent wrench head at the other end of the tool. However, the drivers require independent operation thereof to present one or another for use, and the wrench likewise requires independent operation from the drivers for adjustment of its jaws. Such independent operation requires space for the screw operators in the tool body housing undesirably increasing the size thereof and also leads to a relatively complicated tool which is undesirable.

SUMMARY OF THE INVENTION

In accordance with this invention, an adjustable, manually operable tool for applying torque to fastening elements as a wrench and to slotted fastening elements as a driver is provided which overcomes the aforementioned problems of the prior art.

The adjustable tool herein includes first and second elongate body members each having first and second ends. A torque surface is formed at one of the first and second ends of each of the body members. The torque surfaces are adapted for engagement with workpiece surfaces such as the flats of polygonal fastening elements. Driver heads are formed at other of the ends of the body members and are adapted for engagement in slots of slotted fastening elements with the first body member driver head configured differently from the second body member driver head. The body members are secured together to allow relative movement therebetween with the torque surface of the first body member and the torque surface of the second body member generally facing each other and cooperating to define an adjustable opening therebetween. The driver heads of the body members are adjacent to each other for exposing one of the heads beyond the other. A single adjusting nut is provided with screw threads formed on one of the body members and receiving and cooperating with the nut thereon to allow the nut to be turned to move the body members relative to each other and simultaneously: (1) change the size of the opening between the torque surfaces of the body members for engaging differently sized polygonal fastening elements, and (2) move the driver heads for exposing an appropriately configured one of the driver heads beyond the other drive head for matingly engaging slotted fastening elements having differently configured slots. Thus, the tool herein provides for a compact, easy-to-use tool which by way of a single adjusting mechanism allows for both changing the size of the opening between torque surfaces for a wrenching operation and for changing the driver head so the properly configured driver head in conformity with a specific slotted fastener is presented for a driving operation.

In one form, the torque surfaces generally lie in a horizontal plane and the driver heads are vertically offset from the horizontal plane. In another form, the torque surfaces generally lie in a horizontal plane and the elongate body members include intermediate gripping portions between their torque surfaces and driver heads vertically offset from the horizontal plane. By offsetting the torque surfaces, driver heads and gripping portions, an ergonomic tool is provided which allows for improved access to fastening elements located in otherwise difficult-to-access areas or on fastened bodies having surfaces where the users may have difficulty in properly orienting tools that are not offset for torquing operations and, accordingly, which renders application of torque with the tool to these fastening elements easier.

The nut can have oppositely facing end surfaces spaced at a first distance from each other and the other body member can include facing retaining surfaces spaced at a second distance from each other slightly greater than the first distance. Thus, with the body members secured together, the nut is mounted on the screw thread between the retaining surfaces which thereby maintain the nut in a substantially fixed axial position on the screw threads after turning and release of the nut and during and after a torquing operation with the tool as by engagement of the nut end surfaces with the retaining surfaces. The driver heads and torque surfaces are movable relative to each other in a first direction along the length of the elongate members and turning of the nut is generally in a plane transverse to the first direction.

In one form, the driver heads and torque surfaces are movable relative to each other along the length of the elongate members with the torque surfaces being spaced vertically from the driver heads and the nut bore and screw threads being substantially vertically aligned with at least one of the driver heads.

The tool can be provided in combination with a sleeve handle for receipt of a portion of the elongate members including the torque surfaces in the sleeve to allow the sleeve handle to be gripped and turned for application of torque through the exposed driver head to a slotted fastening member. Preferably, the sleeve handle is formed from a non-metallic material such as plastic or rubber and is configured to be gripped and turned which allows a user to more easily apply higher levels of torque through the tool than without the sleeve.

The elongate body members can be unitary metallic members. This provides a relatively simple and inexpensive design and ease of assembly while attaining a highly versatile tool for use in a broad range of different fastening applications.

In one form, one of the driver heads has a flat blade configuration and the other driver head has a cross-blade Phillips head configuration. Turning of the nut in a first rotational direction simultaneously causes the Phillips head to extend past the flat blade head and enlarges the opening between the facing torque surfaces. Turning of the nut in a second rotational direction opposite to the first rotational direction simultaneously causes the Phillips head to retract exposing the flat blade head and reduces the size of the opening between the facing torque surfaces. Thus, the tool herein can be used to apply torque to different sizes of non-slotted fastening elements as well as to different types of fastening elements having slotted heads, including those requiring Phillips head drivers. In addition, a user need not operate different adjusting mechanisms to present the appropriate driver for use and present an appropriately sized box wrench-type opening for use as in the German '492 patent. Instead, a single adjusting nut is operable to both change driver heads and adjust the wrench opening providing the present hand-held tool with a simpler, more efficient and compact design.

In another form of the invention, the screw thread is formed on one of the body members as before with the one body member having a first longitudinal axis. The driver head and screw thread of the one body member are aligned along the first longitudinal axis. The other of the first and second elongate body members has a second longitudinal axis which coincides with the first longitudinal axis when the body members are secured together to define a tool longitudinal axis. In this manner, the tool herein is easy-to-use and versatile in that it is capable of use with different sizes and types of fasteners and is also provided with a compact design which makes it particularly ideal for those who do not want to carry around the bulkier and/or harder to operate combination tools of the prior art or even a more complete conventional tool set. Thus, the tool herein is particularly suited for use by motorists, cyclists and the like.

The torque surface of the other body member can be offset from the tool longitudinal axis a first predetermined distance and the driver head of the other body member can be offset from the tool longitudinal axis a second predetermined distance less than the first predetermined distance. The torque surface of the one body member can be offset from the tool longitudinal axis a third predetermined distance with the third predetermined distance being substantially the same as the first predetermined distance. By creating the body members with bent designs such that the various torquing portions thereof, i.e., the torque surfaces and driver heads, are offset to each other, the present combination tool is versatile and more easily utilized while still achieving a compact design.

In one form, a reference plane extends through the tool longitudinal axis perpendicular to the body members with the driver heads and with the torque surfaces being aligned along the plane. Each of the torque surfaces can include a pair of surfaces which meet and form an obtuse angle with each other with the plane extending through the pairs of surfaces bisecting the obtuse angles formed thereby. The symmetry of the present tool is well adapted to resist repeated responsive forces generated during torquing operations by substantially equalizing their distribution in the tool body on either side of the tool longitudinal axis.

In one form, the other elongate body member has a first slot formed thereon at its one end and a second slot formed thereby between the driver head at its other end and the first slot. With the body members secured, the one body member torque surface can be movable in the first slot and the one body member screw thread can be movable in the second slot with the first and second slots being substantially aligned with each other along the tool longitudinal axis. A securing member can be provided for attaching to the other body member to secure the body members together and allow for turning of the nut to cause relative movement therebetween. The securing member can cooperate with the other body member to define a screw thread receiving channel leading to the second slot into and out of which the screw thread can be alternately retracted and extended upon turning of the adjusting nut in opposite directions.

DETAILED DESCRIPTION OF THE PREFERRED EMBODIMENT

Figure 1:
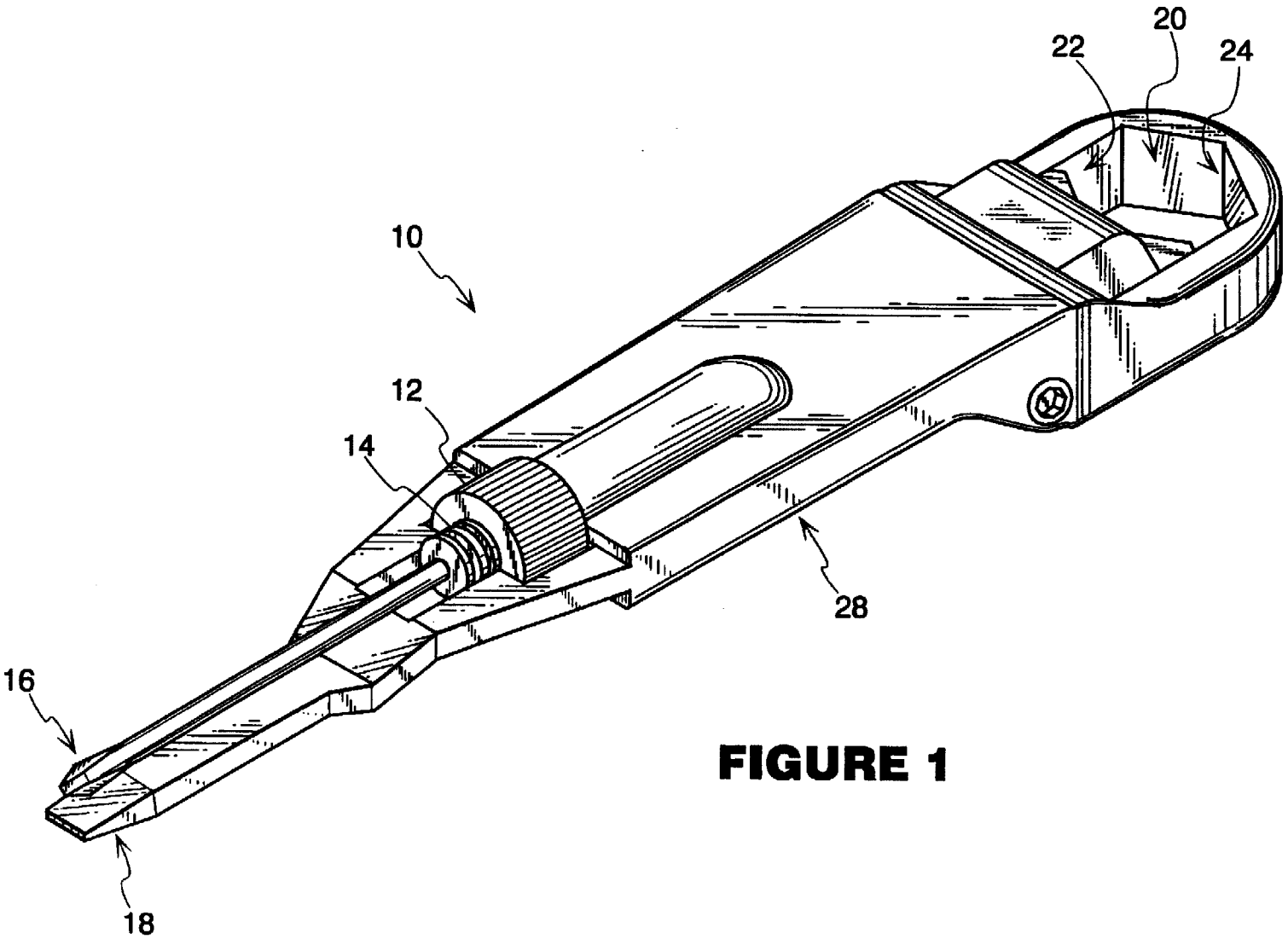
FIG. 1 is a perspective view of a multi-purpose tool according to the present invention and shows a pair of adjacent driver heads at one end of the tool and an adjustable wrench opening formed at the other end with a single adjusting nut received on screw threads between the tool ends.
Figure 2:
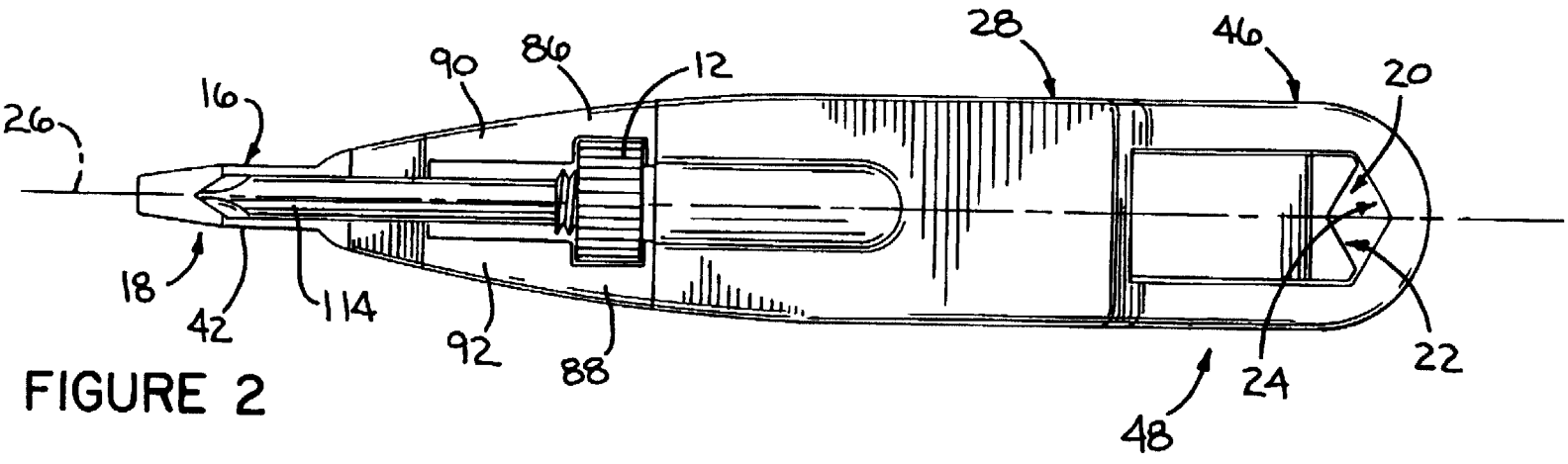
FIG. 2 is a top plan view of the hand tool of FIG. 1 with the adjusting nut operated to retract the Phillips head blade and decrease the size of the wrench opening.
Figure 3:
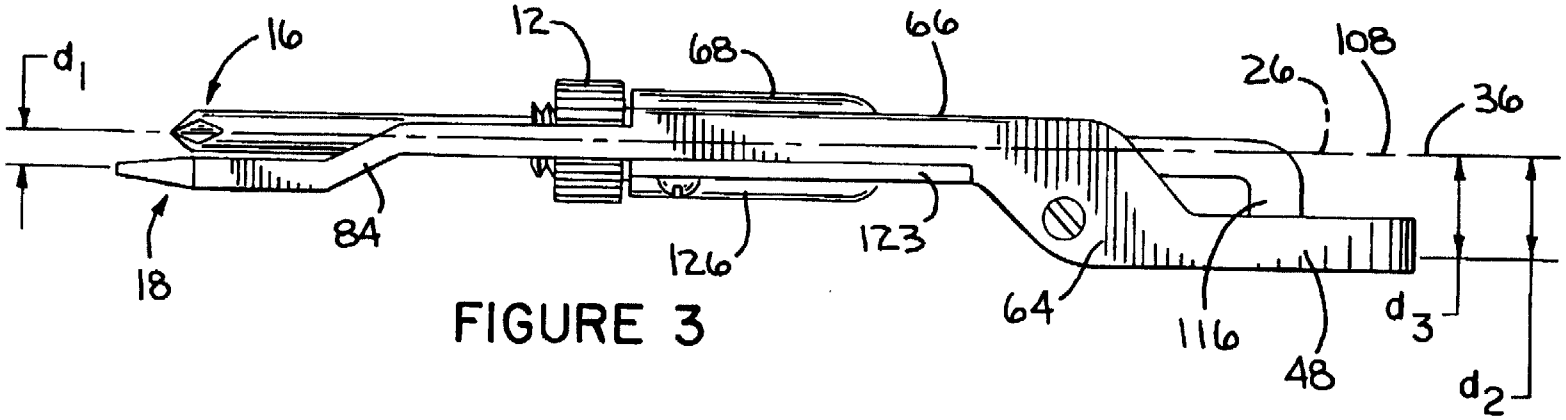
FIG. 3 is a side elevation view of the hand tool as seen in FIG. 2 showing the flat blade head extending beyond the Phillips head.
Figure 5:
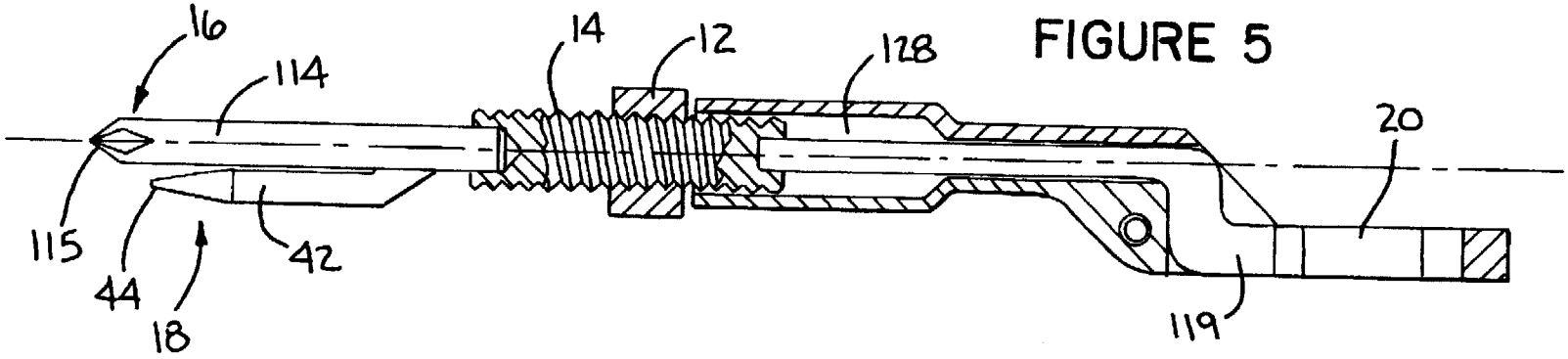
FIG. 5 is an elevation view, partially in section, showing the nut operated to extend the Phillips head beyond the flat blade head and enlarge the wrench opening.
Figure 6:
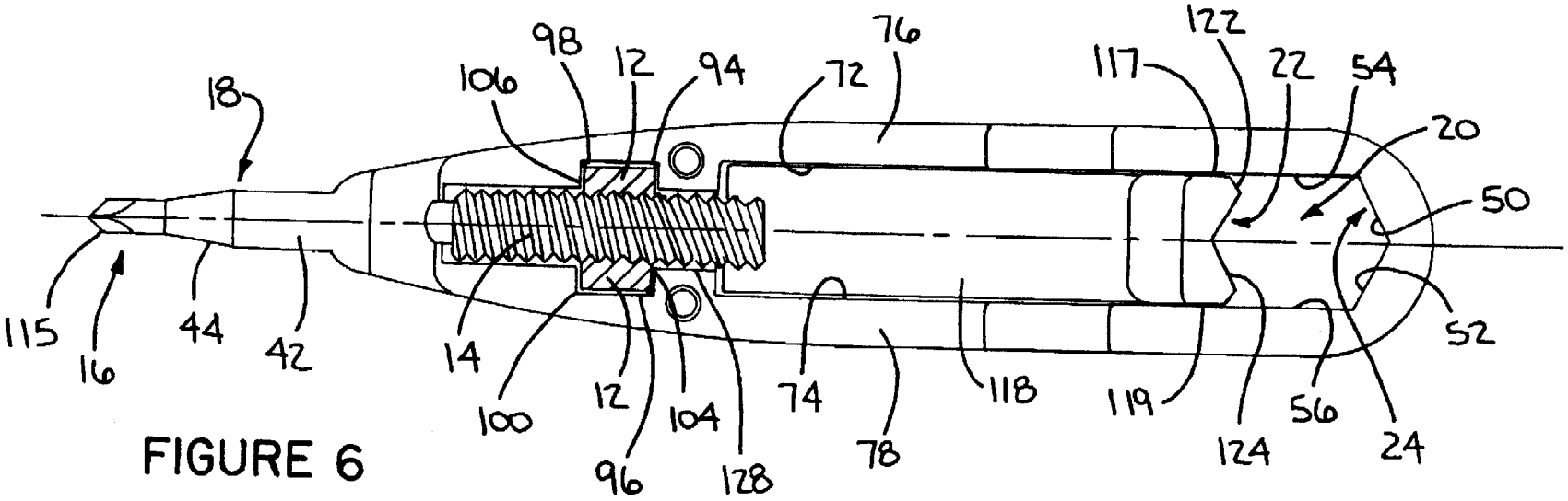
FIG. 6 is a bottom plan view of the tool of FIG. 5 with the securing plate removed to show the screw thread extending in a slot formed in one of the body members.

FIG. 1 illustrates a multi-purpose hand tool 10 according to the invention which can be adjusted by an adjusting nut 12 received on screw threads 14 to present one of the driver heads 16 or 18 for mating engagement with a slotted fastening element (not shown) such as a slotted round or flat head screw, and to change the size of an adjustable opening formed between torque surfaces 22 and 24 for engaging non-slotted fastening elements (not shown), such as bolt heads and nuts. Thus, by way of a single adjusting nut 12, a user can both change the driver head 16 or 18 and adjust the wrench opening 20. For example, by turning the nut in the counter clockwise rotational direction as viewed from the driver head end of the hand tool 10, the driver head 16 will retract to expose the driver head 18 beyond the driver head 16 and the adjustable opening 20 will be decreased in size as by the movement towards one another of the torque engagement surfaces 22 and 24, as seen in FIGS. 2 and 3. On the other hand, rotation in an opposite, clockwise rotational direction extends the driver head 16 beyond the driver head 18 and causes the adjustable opening 20 to increase in size by movement of the torque engagement surfaces 22 and 24 away from each other, as seen in FIGS. 5 and 6.

The multi-purpose hand tool 10 herein is constructed such that rotation of the adjusting nut 12 causes the screw threads 14 to move in a linear direction along the longitudinal axis 26 of the hand tool 10 which extends centrally through the length of the tool 10. Advancing or retracting the screw threads 14 along the longitudinal axis 26 by turning of the nut 12 accordingly causes the driver head 16 and the torque surface 22 to also move linearly in the direction of the longitudinal axis 26. The tool 10 is symmetrical about a reference plane extending perpendicularly to main body 28 of the tool 10 and through the longitudinal axis 26 thereof. With the above alignment of the present tool 10, responsive torsion forces in the tool 10 generated by torquing operations with the tool 10 are more readily distributed without causing as much strain on the balanced structure thereof as the tool 10 does not have parts which move or which include abrupt changes or discontinuities that are misaligned with the tool axis as are present in the previously described combination tools.

Figure 4:
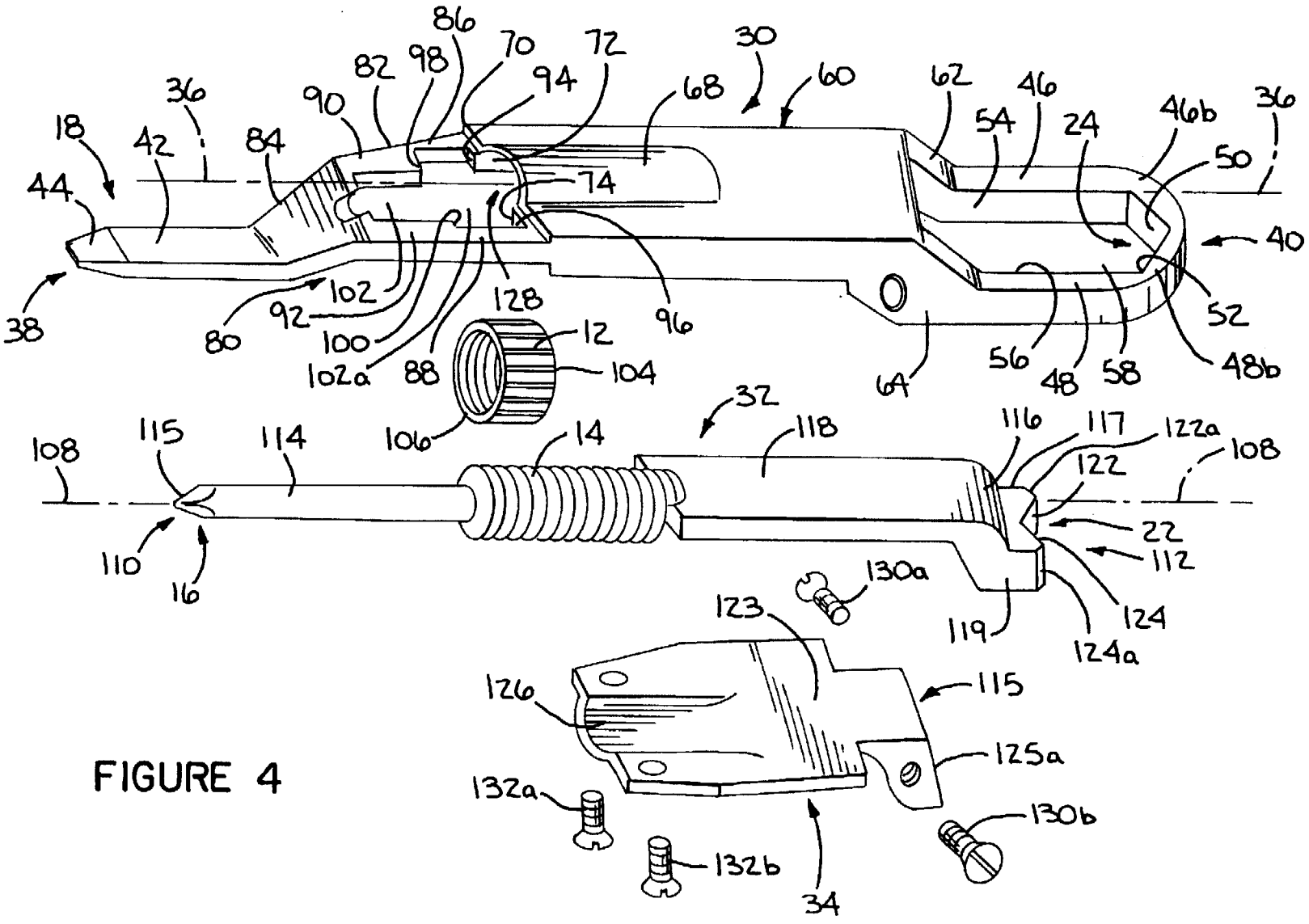
FIG. 4 is an exploded view of the hand tool of FIG. 1 showing two elongate body members each having one of the driver heads formed at one end and a torque surface formed at their other end and a securing plate for securing the two body members together while allowing for relative movement therebetween.

Turning to FIG. 4, the details of the construction of the illustrated and preferred form of the tool 10 will be described. In the preferred form, the tool 10 is constructed with three primary parts in addition to the previously-described adjusting nut 12. These parts include a first elongate guide member 30 and a second elongate movable member 32 with the first and second members 30 and 32 being secured together by a securing member 34. The three-piece construction provides ease of assembly and a relatively compact tool which can be used to perform torquing actions on a variety of different fastening elements. While it is preferred to use the three-piece construction of the preferred form for ease of manufacture and assembly, it will be appreciated that more parts can be used while still providing a relatively compact, multi-purpose tool which falls within the purview of the invention, one such tool 10*a* being shown in FIGS. 7 and 8 and more fully described hereafter.

Preferably, the first elongate guide member 30 and second elongate movable member 32 are cast as unitary metallic parts. The first elongate guide member 30 has a centrally extending longitudinal axis 36 on either side of which the first member 30 is symmetrical. The first member 30 has driver head 18 formed at one end 38 thereof and torque surface 24 formed at the other opposite end 40 thereof. The driver head 18 is formed at the end of a rectangular bar-shaped shank 42. The driver head 18 is chiseled at the end of the shank 42 so that it has a flat blade configuration with the flat blade head 44 adapted to engage conventional screw-type slotted fastening elements.

The first member 30 has a lower pair of parallel guide walls 46 and 48 extending on either side along the longitudinal axis 36 to the rounded end 40. In a preferred form, the torque surface 24 includes a pair of flat surfaces 50 and 52 on the inner side of the rounded end 40 which meet and define an obtuse angle of approximately 120° therebetween and which is bisected by the plane extending through the tool longitudinal axis 26 with the tool 10 assembled. The engagement surfaces 50 and 52 extend away from each other to meet guide surfaces 54 and 56 formed on respective inner sides of the parallel guide walls 46 and 48, and also form 120° obtuse angles therewith so that the surfaces 50–56 are adapted to engage and apply torque to hexagonally shaped fastening elements, such as hexagonal bolt heads and nuts. The surfaces 50–56 taken together define a first slot 58 formed at the end 40 of the first elongate guide member 30.

The first elongate guide member 30 has a main body portion 60 connected to the lower walls 46 and 48 by vertical side portions 62 and 64, respectively. The main body portion 30 can be gripped for turning or pushing and pulling to use the driver heads 16 and 18 or torque surfaces 22 and 24 for application of torque to fastening elements and extends from the top of side portions 62 and 64 towards end 38 and has a substantially flat top surface 66. The top surface 66 is provided with a raised curved portion 68 extending from the middle of the top surface 60 to end 70 thereof. Interior facing guide surfaces 72 and 74 are formed on respective longitudinally extending second member guides 76 and 78 of the main body portion 60. The curved top portion 68 extends across the top edges of the guide surfaces 72 and 74 between the guides 76 and 78. A bent tongue 80 is formed intermediate the flat blade shank 42 and the guides 76 and 78 and includes a flat, slotted portion 82 leading to an inclined portion 84 which is adjoined to the rear of the shank 42. Referring to FIG. 3, the inclined tongue portion 84 does not extend vertically down from the body 30 as far as the bottom of the vertical side portions 62 and 64 such that the shank 42 and its flat blade head 44 are offset from the main body portion 60 a predetermined distance $d_1$ as measured from the longitudinal axis 36 and the mid-point of the torque surface 24 is offset from the longitudinal axis 36 a predetermined distance $d_2$ with the distance $d_1$ being less than the distance $d_2$.

The slotted portion 82 includes opposite narrow slot forming sides 86 and 88 leading to wider slot forming sides 90 and 92, respectively, which connect to the transverse ends of the guides 76 and 78. The guide ends extend inwardly beyond the narrow slot forming sides 86 and 88 to form retaining surfaces 94 and 96 for the nut 12. Likewise, shoulders defined between the narrow sides 86 and 88 and the wide slot forming sides 90 and 92 define retaining surfaces 98 and 100 for the nut 12. Thus, with the tool 10 assembled, the screw thread 14 can move in second slot 102 defined by the narrow slot forming sides 86 and 88 and the wider slot forming sides 90 and 92 by rotation of the adjusting nut 12.

The second slot 102 has a wide section 102*a* thereof in which the nut 12 received on the threads 14 is retained. More specifically, the nut 12 is formed so that the outer diameter of the nut 12 is slightly less than the distance across the wide slot section 102*a* between sides 90 and 92 and the width of the nut from end surface 104 to end surface 106 is at a distance slightly less than the distance across the retaining surfaces 94 and 96 and 98 and 100, as best seen in FIG. 6. In this manner, after the screw 12 has been turned to present the appropriate driving head 16 or 18 for engagement in a slotted fastening element and/or adjust the opening 20 to its desired size for engaging a non-slotted fastening element, the retaining surfaces 92–98 act to maintain the nut 12 in its adjusted axial position relative to the screw threads 14 after release of the nut 12 and during torquing operations utilizing the tool 10.

The second movable elongate member 32 has a substantially centrally extending longitudinal axis 108 and opposite ends 110 and 112 thereof spaced at a distance that is less than the distance between ends 38 and 40 of the first elongate member 30. The second member 32 is aligned about its axis 108 and a cylindrical shaft 114 extends from the threads 14 along the longitudinal axis 108 with driver head 16 formed at the end thereof. The driver head 16 has a cross blade Phillips head configuration for mating with correspondingly configured slotted fastening elements. Opposite the Phillips head 115, a substantially L-shaped foot 116 depends from guided bar portion 118 with the screw threads 14 extending from the other end of the bar portion 118 to the shaft 114, as described above. Thus, the second member 32 has the Phillips head 115, shaft 114, threads 14 and guided bar portion 118 all aligned on longitudinal axis 108.

The torque surface 22 is formed at the lower end of the foot 116 between outer guided surfaces 117 and 119 thereof. As with the torque surfaces 24, the torque engagement surface 22 can include a pair of engagement surfaces 122 and 124 which meet and form an obtuse angle with each other, preferably of 120°, for engagement with hex fastening member surfaces. With the tool 10 assembled, the plane extending perpendicularly through the main body portion 60 of the first elongate member 30 will similarly extend perpendicularly through the bar portion 118 and through the longitudinal axis 108 to bisect the obtuse angle formed by the surfaces 122 and 124. In the assembled tool 10, the surfaces 122 and 124 extend away from each other towards inner wall surfaces 54 and 56, respectively, at an angle thereto which is again preferably an obtuse angle of 120° adapted for engagement with hexagonally shaped fastening elements.

The securing member 34 can secure the elongate members 30 and 32 together to allow the turning of nut 12 to cause the elongate member 32 to move relative to the member 30. More specifically, the securing member 34 can be in the form of a plate member 123 having mount 125 extending centrally from the rear side of the plate member 123 and depending downwardly therefrom. The extending mount 125 is narrower across its width than the plate member 123. The plate member 123 has a curved recessed portion 126 extending forward from the middle of the plate member 123 to the front side thereof.

The width of the guided bar portion 118 of the movable elongate member 32 is slightly less than the distance across the guiding surfaces 72 and 74. To assemble the tool 10, the nut 12 is threaded onto the threads 14 and the bar portion 118 of the second elongate movable member 32 is placed between the guiding surfaces 72 and 74 with the mounting nut 12 contained in the wide slot section 102*a* of the second slot 102 and the torque surfaces 122 and 124 in the first slot 58 facing the torque surfaces 50 and 52 as the second elongate member 32 is not as long as the first elongate member 30. Thereafter, the securing member 34 is secured to the first elongate guiding member 30 to allow turning of the screw 12 to cause the screw threads 14 to advance and retract out of and into a screw thread receiving channel 128 defined between the raised curved top portion 68 of the main body portion 60 of the elongate member 30 and the curved recessed portion 126 in the plate member 123 of the securing member 34.

As previously mentioned, the extending mount 125 of the securing member 34 is not as wide as the plate member 123. The width of the plate member 123 substantially corresponds to the width of the main body portion 60 with the width of the mount 125 substantially corresponding to the distance across the inner surfaces of the vertical sides 62 and 64. To attach the securing member 34 to the elongate member 30, the mount 125 is placed tightly between the sides 62 and 64 with lateral mounting holes therein aligned with lateral mounting holes extending through the side portions 62 and 64 and adapted to receive a screw fastening elements 130*a* and 130*b*. Similarly, the plate member 123 can have mounting holes formed therein on either side of the curved recessed portion 126 which can be aligned with blind holes (not shown) formed in the bottom of the longitudinal guides 76 and 78 on either side of the curved raised portion 68 and adapted to receive screw fastening members 132*a* and 132*b* therethrough. Thus, with the fastening element 34 screwed to the elongate member 30 with the elongate member 32 movably mounted therebetween, the longitudinal axes 36 and 108 of the first and second elongate members 30 and 32, respectively, will coincide with one another and define the longitudinal axis 26 for the tool 10.

In its assembled state and referring to FIG. 3, the torque engagement surfaces 50 and 52 and 122 and 124 are facing and vertically aligned as the distances $d_2$ and $d_3$ are the same and are offset from the flat blade head 44 and Phillips head 115. By spacing the torque surfaces 20 and 22 from the main body 38, a user can fit a fastening element in the opening 20 and apply torque thereto through a grip on the body 28 which does not require the user's fingers to be aligned with the plane of the body to which the fastening element is attached. This is particularly important where such orientation of the hand is not possible, such as when the fastening element protrudes above a flat surface of the fastened body where the length of the tool 10 requires that it be over the flat surface during the torquing operation. For the tool 10 to be used as a wrench in this situation, the tool 10 must be angled relative to the surface so the user does not bang their fingers thereon. Angling the tool 10 can jeopardize the engagement of the torque surfaces 20 and 22 with the fastening element especially during the torquing operation and may require reduction in the torque that can be safely applied with the tool 10 without slippage off of the fastening element.

As previously described, the Phillips head 115, its shaft 114, screw threads 14 and bar portion 118 are all aligned along the longitudinal axis 108 without an offset therefrom, and when the tool 10 is assembled the axis 108 is coaxial and coincides with first member longitudinal axis 36 to define the tool axis 26. Thus, in the assembled tool 10, the flat blade head 44 is spaced from the tool axis 26 and, therefore, from the Phillips head 16 which is aligned on the tool axis 26, a distance $d_1$, which is less than the distances $d_2$ and $d_3$, such that the driver heads 44 and 115 are adjacent each other. In this manner, two different drivers 44 and 115 are provided in a compact tool 10 which is easily operable as by single adjusting nut 12. In the preferred form, the diameter of the shaft 114 is less than the distance across the rod shaped shank 42 such that the shank 42 is visible even when viewed with the cylindrical shaft 114 in overlying relation thereto.

In practice, rotation of the nut 12 in a counter clockwise rotational direction, as viewed from the driver heads of the tool 10, causes the screw threads 14 to retract from the second slot 102 into the screw thread receiving channel 128, thereby presenting the flat blade head 44 exposed beyond the cross blade Phillips head 115. Simultaneously, turning of the nut 12 in the counter clockwise direction also causes the torque surfaces 122 and 124 to guidingly move in the first slot 54 by engagement of guided surfaces 117 and 119 with guiding surfaces 54 and 56, respectively, towards the torque surfaces 50 and 52 thereby adjusting the opening 20 to make the opening 20 smaller. The torque surfaces 122 and 124 each include bevelled stops **122*a* and 124*a* which can abut the torque surfaces 50 and 52 when the screw threads, 14 are retracted to act as stops to prevent the torque surfaces 122 and 124 from continued movement towards torque surfaces 50 and 52 thereby limiting the reduction in size of the opening 20 therebetween. On the other hand, when the nut 12 is turned in a clockwise rotational direction as viewed from the driver heads, the screw threads 14 advance from the screw thread receiving channel 128 into the second slot 102 to present the cross blade Phillips head 115 beyond the flat blade head 44 for use. Simultaneously, the torque surfaces 122 and 124 are caused to guidingly move in first slot 58 away from the torque surfaces 50 and 52 to thereby enlarge the opening 20. Engagement of the foot 116 with the rear 125*a* of the mount 125 when the screw threads 14 are advanced stops the movement of the torque surfaces 122 and 124 away from the torque surfaces 50 and 52 thereby limiting the enlargement in size of the opening 20 therebetween. Thus, through single adjusting nut 12, a user can utilize tool 10** on a wide variety of different types and sizes of fastening elements and perform torquing operations thereon.

Figure 7:
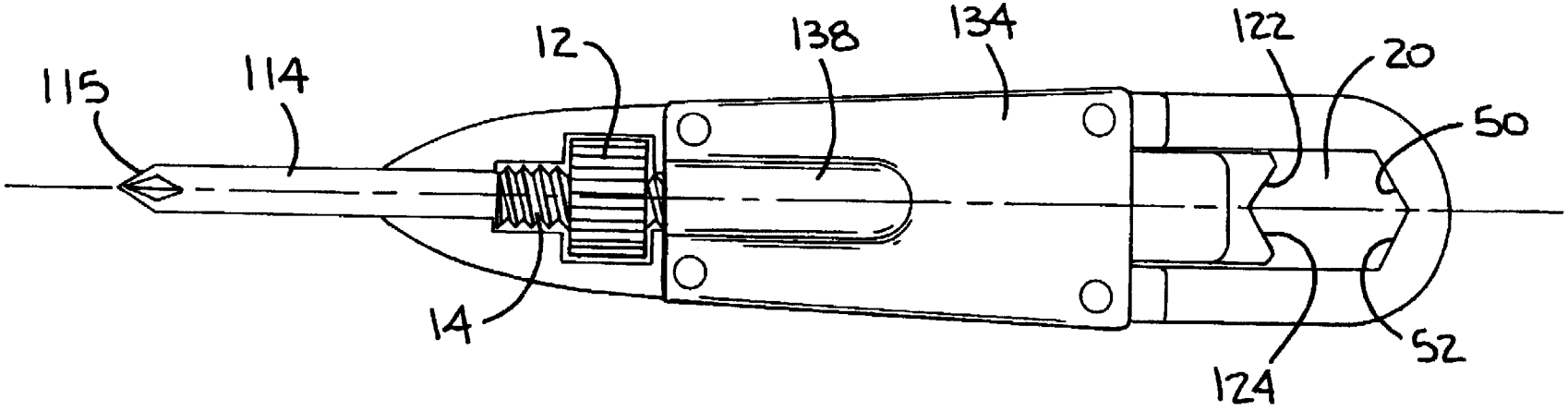
FIG. 7 is a modified hand tool according to the present invention utilizing a pair of plate members for securing the elongate body members to each other.
Figure 8:
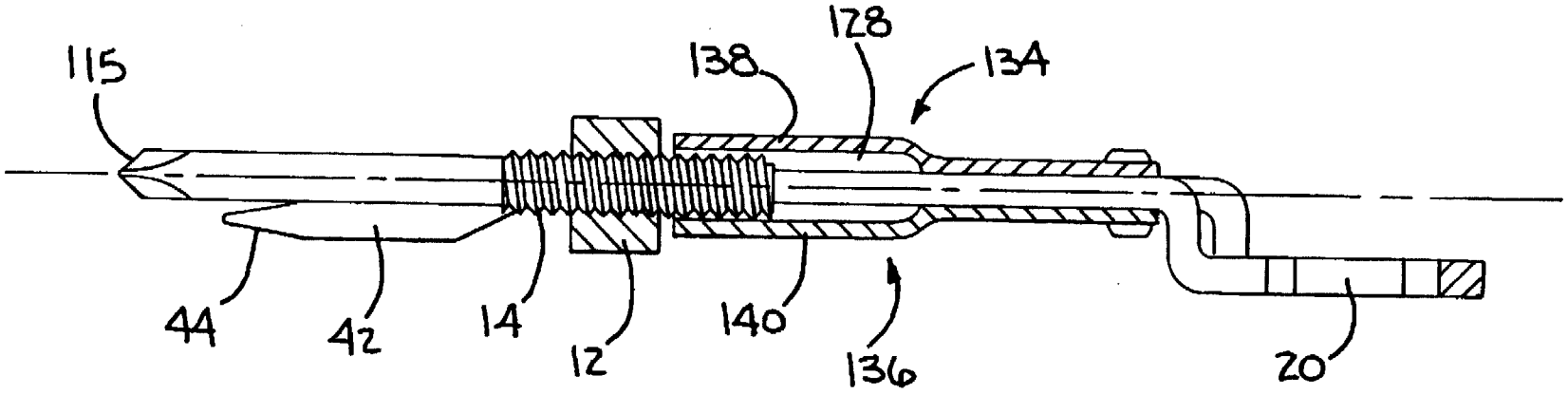
FIG. 8 is a side elevation view, partially in section, of the hand tool of FIG. 7.

Turning to FIGS. 7 and 8, a modified form of the tool 10 is illustrated. In the form illustrated in FIGS. 1–6, the first and second elongate members 30 and 32 and securing member 34 were all cast unitary metallic parts. In the modified tool **10*a* of FIGS. 7 and 8, the parts are formed from smaller stamped metallic parts and thus form a smaller tool 10*a* when assembled for use with smaller fastening elements. FIGS. 7 and 8 illustrate the nut 12 rotated in a clockwise rotational direction to advance the cross blade Phillips head 115 beyond the flat blade head 44. In addition, the opening 20 between the torque surfaces 50 and 52 and torque surfaces 122 and 124 is enlarged as previously described with respect to tool 10**.

In this smaller version of the tool 10, the rod shaped shank 42 of the elongate member 30 can have a width substantially corresponding to the diameter of the cylindrical shaft 114 such that when the tool **10*a* is viewed with the shaft 114 in overlying relation to the shank 42 as in FIG. 7, the shank 42** will be substantially blocked from vision, although this is a less preferred form.

The main difference between the smaller version tool **10*a* of FIGS. 7 and 8 and the larger cast version of FIGS. 1–6, is that the securing member 34 in FIGS. 7 and 8 is a pair of plate members 134 and 136 with the upper plate member 134 having a raised curved portion 138 and the lower plate member 136 having a recessed curved portion 140 for forming the screw thread receiving channel 128. As the securing plate members 134 and 136 cooperate to form the screw thread receiving channel 128, the main body portion 60 of the elongate member 30 is also modified so that it no longer includes the raised curved portion 68 and only includes sides 62 and 64 and guides 76 and 78. The plate members 134 and 136 can be provided with mounting holes and the guides 62 and 64 of the elongate member 30 can be provided with vertical mounting holes therethrough such that with the plate members 134 and 136 placed on the top and bottom of the main body portion 60, the mounting holes can be moved into alignment with each other so that the plate members 134 and 136 and main body portion 60 can be secured together as by a riveted connection. Thereafter, the modified tool 10*a* of FIGS. 7 and 8 is operated in the same fashion in all respects thereof as the cast tool 10 of FIGS. 1–6**.

Figure 9:
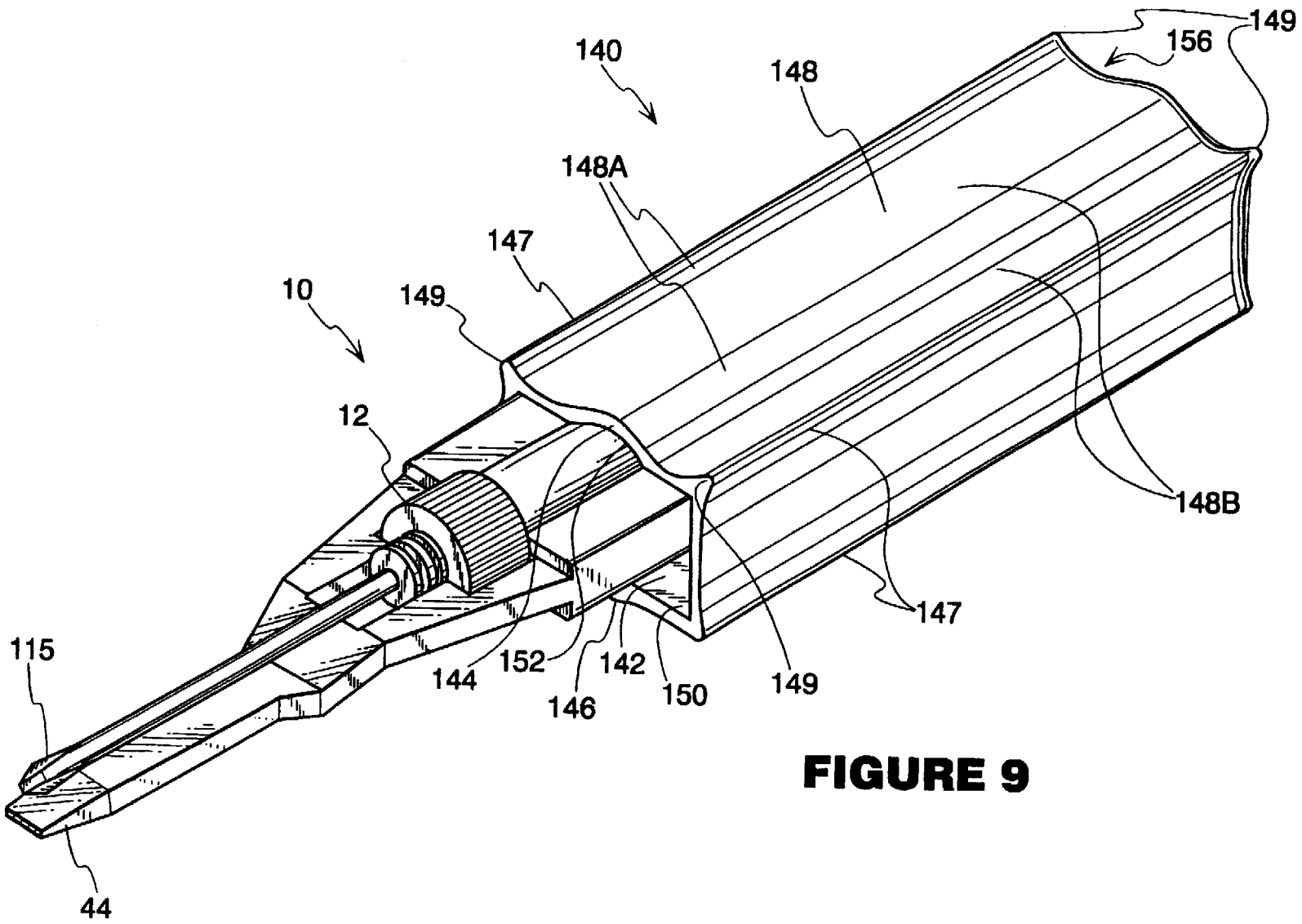
FIG. 9 is a perspective view of the tool according to the present invention having a sleeve handle thereon.

Referring to FIG. 9, a sleeve handle 140 formed from a resilient plastic or rubber-like material can be provided to improve the levels of and ease with which torque can be applied with driver heads 44 and 115 to slotted fastening elements then if the user were to simply grip and turn the metallic tool body 28. The sleeve handle 140 defines a tool receiving interior 142 having a width substantially corresponding to the width of the tool body 28 and has elongate curved channels 144 and 146 in the top and bottom thereof in which the top raised portion 68 and bottom recessed portion 126 can fit. In addition, the edges 147 extending between the sleeve corners 149 can be raised thereby providing the sleeve 40 with a contoured surface 148 on the top and bottom thereof forming peaks **148*a* and valleys 148*b* for easier and more secure gripping and turning. The distance from the top of the raised portion 68 to the bottom of the end 40 of the tool 10 substantially corresponds with the distance from the flat bottom inner surface portion 150 to the top of the curved underside 152 of the top channel 144 in the sleeve interior 142. Thus, with the rounded end 40 inserted in the sleeve interior 142 until it abuts the inner side of the back 156 of the sleeve 140, the tool 10 will be tightly secured in the sleeve interior 142 to prevent the sleeve 140 from slipping and turning over the tool 10 during torquing so that gripping and turning the sleeve 140 will transmit the torquing force to one of the driver heads 44 and 115 mated in an appropriately configured slotted fastening element. Further, the sleeve handle 140, while containing the torque surfaces 22 and 24 and most of the tool body 28 in its interior 142, is not so long as to cover the adjusting nut 12 when the tool end 40 abuts the inner back 156 of the sleeve 140, thus leaving the adjusting nut 12 readily accessible for changing driver heads 44 and 115**.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. An adjustable manually operable tool for applying torque to workpieces as a wrench and to slotted fastening elements as a driver, the tool comprising:

first and second elongate body members each having first and second ends with the first and second ends being vertically offset from each other;

a torque surface formed at one of the first and second ends of each of the body members adapted for engagement with workpiece surfaces;

a driver head formed at the other of the ends of each of the body members adapted for engagement in slots of slotted fastening elements with the first body member driver head configured differently from the second body member driver head;

the body members being secured together with the torque surface of the first body member and the torque surface of the second body member generally facing each other and cooperating to define an adjustable opening therebetween, and the driver heads being adjacent each other for exposing one of the heads beyond the other; and a single adjusting nut and screw threads formed on one of the first and second body members receiving and cooperating with the nut to allow the nut to be turned to move the body members relative to each other and simultaneously: (1) change the size of the opening between the facing torque surfaces of the body members for engaging differently sized workpieces, and (2) move the driver heads for exposing an appropriately configured one of the driver heads beyond the other driver head for matingly engaging slotted fastening elements having differently configured slots, the one body member having a first longitudinal axis and its driver head and screw threads being aligned along the first longitudinal axis and the other of the first and second elongate body members having a second longitudinal axis which coincides with the first longitudinal axis with the body members secured together to define a tool longitudinal axis about which the first and second body members are symmetrically, wherein a reference plane extends through the tool longitudinal axis perpendicular to the body members with the driver heads and the torque surfaces being aligned along the plane.

2. An adjustable manually operable tool for applying torque to workpieces as a wrench and to slotted fastening elements as a driver, the tool comprising:

first and second elongate body members each having first and second ends with the first and second ends being vertically offset from each other;

a torque surface formed at one of the first and second ends of each of the body members adapted for engagement with workpiece surfaces;

a driver head formed at the other of the ends of each of the body members adapted for engagement in slots of slotted fastening elements with the first body member driver head configured differently from the second body member driver head;

the body members being secured together with the torque surface of the first body member and the torque surface of the second body member generally facing each other and cooperating to define an adjustable opening therebetween, and the driver heads being adjacent each other for exposing one of the heads beyond the other; and a single adjusting nut and screw threads formed on one of the first and second body members receiving and cooperating with the nut to allow the nut to be turned to move the body members relative to each other and simultaneously: (1) change the size of the opening between the facing torque surfaces of the body members for engaging differently sized workpieces, and (2) move the driver heads for exposing an appropriately configured one of the driver heads beyond the other driver head for matingly engaging slotted fastening elements having differently configured slots, the one body member having a first longitudinal axis and its driver head and screw threads being aligned along the first longitudinal axis and the other of the first and second elongate body members having a second longitudinal axis which coincides with the first longitudinal axis with the body members secured together to define a tool longitudinal axis, wherein a reference plane extends through the tool longitudinal axis perpendicular to the body members with the driver heads and the torque surfaces being aligned along the plane, and each of the torque surfaces comprises a pair of surfaces which meet and form an obtuse angle with each other with the plane extending through the pairs of surfaces bisecting the obtuse angles formed thereby.

3. An adjustable manually operable tool for applying torque to workpieces as a wrench and to slotted fastening elements as a driver, the tool comprising:

first and second elongate body members each having first and second ends with the first and second ends being vertically offset from each other;

a torque surface formed at one of the first and second ends of each of the body members adapted for engagement with workpiece surfaces;

a driver head formed at the other of the ends of each of the body members adapted for engagement in slots of slotted fastening elements with the first body member driver head configured differently from the second body member driver head;

the body members being secured together with the torque surface of the first body member and the torque surface of the second body member generally facing each other and cooperating to define an adjustable opening therebetween, and the driver heads being adjacent each other for exposing one of the heads beyond the other; and a single adjusting nut and screw threads formed on one of the first and second body members receiving and cooperating with the nut to allow the nut to be turned to move the body members relative to each other and simultaneously: (1) change the size of the opening between the facing torque surfaces of the body members for engaging differently sized workpieces, and (2) move the driver heads for exposing an appropriately configured one of the driver heads beyond the other driver head for matingly engaging slotted fastening elements having differently configured slots, the one body member having a first longitudinal axis and its driver head and screw threads being aligned along the first longitudinal axis and the other of the first and second elongate body members having a second longitudinal axis which coincides with the first longitudinal axis with the body members secured together to define a tool longitudinal axis, wherein the other elongate body member has a first slot formed therein at its one end and a second slot formed therein between its driver head at its other end and the first slot and with the body members secured together the one body member torque surface is movable in the first slot and the one body member screw thread is movable in the second slot, and the first and second slots are substantially aligned with each other along the tool longitudinal axis.

4. The tool of claim 3 including a securing member for attaching to the other body member to secure the body members together and allow for turning of the nut to cause relative movement therebetween with the securing member further cooperating with the other body member to define a screw thread receiving channel leading to the second slot into and out of which the screw threads can be alternately retracted and extended upon turning of the adjusting nut in opposite directions.

* * * * *